US011788246B2

(12) United States Patent
Miller et al.

(10) Patent No.: US 11,788,246 B2
(45) Date of Patent: Oct. 17, 2023

(54) MICROPILE CONNECTION FOR SUPPORTING A VERTICAL PILE

(71) Applicants: Dale Clayton Miller, Youngsville, NC (US); Julian Young, Pooler, GA (US)

(72) Inventors: Dale Clayton Miller, Youngsville, NC (US); Julian Young, Pooler, GA (US)

( * ) Notice: Subject to any disclaimer, the term of this patent is extended or adjusted under 35 U.S.C. 154(b) by 0 days.

(21) Appl. No.: 17/546,155

(22) Filed: Dec. 9, 2021

(65) Prior Publication Data

US 2022/0186454 A1 Jun. 16, 2022

Related U.S. Application Data

(60) Provisional application No. 63/125,264, filed on Dec. 14, 2020.

(51) Int. Cl.
*E02D 5/54* (2006.01)
*E02D 5/28* (2006.01)

(52) U.S. Cl.
CPC ..... *E02D 5/54* (2013.01); *E02D 5/285* (2013.01)

(58) Field of Classification Search
CPC .. E02D 5/54; E02D 5/80; E02D 5/526; E02D 5/285
See application file for complete search history.

(56) References Cited

U.S. PATENT DOCUMENTS 2,001,719 A * 5/1935 Greene ..... E04H 12/223 52/158
2,964,145 A 12/1960 Clatfelter
3,591,113 A 7/1971 Foster, Jr.
3,775,918 A 12/1973 Johnson
3,964,404 A 6/1976 Mueller et al.
4,012,883 A 3/1977 Muller
4,090,364 A 5/1978 Muller
4,189,125 A 2/1980 Little
4,295,308 A 10/1981 Korfanta
4,378,179 A 3/1983 Hasle
4,402,166 A 9/1983 Wortham, Jr.
4,431,347 A 2/1984 Gillen, Jr.
(Continued)

FOREIGN PATENT DOCUMENTS

DE 823336 C 11/1952
DE 102009037175 A1 2/2011
(Continued)

OTHER PUBLICATIONS

Author Unknown, "Foundation Brackets: A Stronger Foundation," Product Page, magnumpiering.com/product-category/foundation-brackets/, accessed Nov. 11, 2020, Magnum Piering, 13 pages.
(Continued)

*Primary Examiner* — Sean D Andrish
(74) *Attorney, Agent, or Firm* — Withrow & Terranova, P.L.L.C.; Vincent K. Gustafson

(57) ABSTRACT

A micropile connection for supporting a vertical pile for a support system is disclosed herein. The micropile connection includes a base and two micropile sleeves attached thereto. The two micropile sleeves are configured to direct micropiles from opposing sides of the base across the base, such that the two micropiles cross through a vertical plane intersecting the base and between lateral edges of the base.

20 Claims, 7 Drawing Sheets

(56) References Cited

U.S. PATENT DOCUMENTS

| | | | |
|---|---|---|---|
| 4,899,497 | A | 2/1990 | Madl, Jr. |
| 5,039,256 | A | 8/1991 | Gagliano |
| 5,065,975 | A | 11/1991 | Giles |
| 5,104,074 | A | 4/1992 | Malloy |
| D335,435 | S | 5/1993 | Lawson |
| 5,395,184 | A | 3/1995 | Gagliano |
| 5,501,550 | A | 3/1996 | Calabrese |
| 5,515,656 | A | 5/1996 | Mihalich |
| 5,791,635 | A | 8/1998 | Hull et al. |
| 5,873,679 | A | 2/1999 | Cusimano |
| D409,764 | S | 5/1999 | Laga |
| 5,961,093 | A | 10/1999 | Jones et al. |
| D423,686 | S | 4/2000 | Swain |
| D437,544 | S | 2/2001 | Oliver et al. |
| 6,298,618 | B1 | 10/2001 | Lawson |
| 6,368,021 | B1 | 4/2002 | Strong et al. |
| D495,426 | S | 8/2004 | Yamaoka |
| 6,979,151 | B1 | 12/2005 | Bourgeo |
| 7,610,733 | B2 | 11/2009 | Rizzotto |
| 7,681,373 | B2 | 3/2010 | Kariakin |
| D622,868 | S | 8/2010 | Bajrami |
| D622,869 | S | 8/2010 | Bajrami |
| D666,473 | S | 9/2012 | Despotellis |
| D666,474 | S | 9/2012 | Despotellis |
| D666,895 | S | 9/2012 | Despotellis |
| 8,561,361 | B2 | 10/2013 | Bauletti |
| 8,844,209 | B1 | 9/2014 | Oliver et al. |
| 9,109,355 | B1 | 8/2015 | Strauch |
| D757,959 | S | 5/2016 | Aoi et al. |
| 9,499,998 | B2 * | 11/2016 | Bardelli ..... E04H 12/2269 |
| 9,850,638 | B2 | 12/2017 | Despotellis |
| 10,526,758 | B1 | 1/2020 | Martin et al. |
| D901,282 | S | 11/2020 | Miller et al. |
| 2003/0085482 | A1 | 5/2003 | Sincock et al. |
| 2003/0143036 | A1 | 7/2003 | Larsen, Jr. |
| 2004/0149796 | A1 | 8/2004 | Cohen |
| 2005/0081459 | A1 | 4/2005 | Moroschan |
| 2006/0013656 | A1 | 1/2006 | Blum |
| 2006/0275085 | A1 | 12/2006 | Ong |
| 2007/0158526 | A1 | 7/2007 | Platt |
| 2009/0052994 | A1 | 2/2009 | Lawler |
| 2009/0245977 | A1 | 10/2009 | Edelson et al. |
| 2010/0290843 | A1 | 11/2010 | Irvine et al. |
| 2010/0307073 | A1 | 12/2010 | Oliver et al. |
| 2011/0158752 | A1 | 6/2011 | Hitchin |
| 2013/0086974 | A1 | 4/2013 | Rausche |
| 2014/0311083 | A1 | 10/2014 | Madril |
| 2015/0071712 | A1 | 3/2015 | Kemp et al. |
| 2015/0211200 | A1 | 7/2015 | Nishioka et al. |
| 2015/0292228 | A1 | 10/2015 | Bardelli et al. |
| 2016/0186403 | A1 | 6/2016 | Tomchesson et al. |
| 2017/0101760 | A1 | 4/2017 | Seay |
| 2018/0106010 | A1 | 4/2018 | Despotellis |
| 2018/0106063 | A1 | 4/2018 | De Kleine |
| 2021/0172139 | A1 | 6/2021 | Duncan et al. |
| 2022/0010516 | A1 | 1/2022 | Miller et al. |

FOREIGN PATENT DOCUMENTS

| | | | |
|---|---|---|---|
| EP | 1205605 | A2 | 5/2002 |
| EP | 2360331 | A1 | 8/2011 |
| FR | 2829777 | A1 | 3/2003 |
| JP | 2017186788 | A | 10/2017 |
| WO | 2020080964 | A1 | 4/2020 |

OTHER PUBLICATIONS

Mitchell, Chris, "J & J Nevada—Seismic Retrofit & Tenant Improvement with Micropiles," versagrade.com/2016/02/03/j-j-nevada-seismic-retrofit-tenant-improvement-with-micro-piles/, Feb. 3, 2016, VersaGrade, Inc., Reno, Nevada, 4 pages.

International Search Report and Written Opinion for International Patent Application No. PCT/US21/62527, dated Mar. 22, 2022, 10 pages.

Bruce et al. "Micropiles: the state of practice Part 1: Characteristics, definitions and classifications" Ground Improvement, vol. 1, No. 1, 1997, pp. 25-35.

G., Jared "Commercial Generator Buyer's Guide," Electric Generators Direct, 2020, 5 pages.

Lindapter "Type GF Grate-Fast" http://www.lindapter.com, 2020, 2 pages.

Mason et al. "Lizzi's Structural System Retrofit with Reticulated Internal Reinforcement Method" Transportation Research Record, Paper No. 01-2861, 2001, pp. 107-114.

Mehdizadeh et al. "Static Load Testing of Concrete Free Reticulated Micropiles System" 5th International Conference on Geotechnical and Geophysical Site Characterization, 2016, 6 pages.

Sadek et al. "Influence of micropile inclination on the performance of a micropile network" Ground Improvement, vol. 10, No. 4, 2006, pp. 165-172.

Sunbelt "Temporary Bridging System" https://www.sunbeltrentals.com/equipment/detail/1715/2380001/temporary-bridging-system/, 2020, 3 pages.

Tsukada et al. "Mechanism of Bearing Capacity of Spread Footings Reinforced With Microphiles" Soils and Foundations, vol. 46, No. 3, 2006, pp. 367-376.

Woodstock Power "What to Know Before Installing a Backup Commercial Generator" https://woodstockpower.com, 2020, 7 pages.

You et al. "Behavior of Micropile Foundations Under Inclined Loads in Laboratory Tests" Lowland Technology International, vol. 5, No. 2, 2003, pp. 16-26.

Quayle Action for U.S. Appl. No. 29/706,951, dated Jul. 7, 2020, 6 pages.

Quayle Action for U.S. Appl. No. 29/706,954, dated Nov. 26, 2021, 4 pages.

Non-Final Office Action for U.S. Appl. No. 17/370,280, dated Mar. 23, 2023, 15 pages.

* cited by examiner

MICROPILE CONNECTION FOR SUPPORTING A VERTICAL PILE

RELATED APPLICATIONS

The present application claims priority to U.S. Provisional Patent Application Ser. No. 63/125,264 entitled "MICROPILE CONNECTION FOR SUPPORTING A VERTICAL PILE," filed on Dec. 14, 2020, which is incorporated hereby by reference in its entirety.

FIELD OF THE DISCLOSURE

The disclosure relates to a micropile connection, and more particularly to a micropile connection for supporting a generally vertical pile for a support system.

BACKGROUND

Support structure installations may require vertically driven piles, which must be driven into the ground to a required depth to provide sufficient support. For example, solar farms that include large arrays of solar panels require a correspondingly large number of piles that must be driven to a required depth at precise locations. FIG. 1A illustrates installation of a plurality of vertical fixed piles 100 into the ground 102 for mounting solar panels and FIG. 1B illustrates a solar panel array 104, including the vertical piles 100 supporting solar panels 106.

Often, a pile 100 is partially driven to a required depth but then hits an obstruction, or impediment, resulting in a refusal. A refusal refers to an inability for the pile 100 (or beam) to reach a desired depth to maintain stability of a support structure. The obstruction or impediment (e.g., compacted substrates, rocks, foreign objects, etc.) impedes driving the pile 100 (or beam) to the desired depth. In such circumstances, the pile 100 usually cannot be moved to a different location when large integrated equipment is being installed. Accordingly, some installers remove the pile 100, drill through the obstruction, replace the pile 100, and pour concrete around the installed pile 100. Such a process is slow and expensive. Further, such concerns about refusals may deter installation of the large integrated equipment in advantageous locations if a significant number of rocks or similar impediments exist below the ground surface.

No admission is made that any reference cited herein constitutes prior art. Applicant expressly reserves the right to challenge the accuracy and pertinency of any cited documents.

SUMMARY

Disclosed is a micropile connection for supporting a vertical pile for a support system. The micropile connection includes a base and two micropile sleeves attached thereto. The two micropile sleeves are configured to direct micropiles from opposing sides of the base across the base, such that the two micropiles cross through a vertical plane intersecting the base and between lateral edges of the base. The micropile connection is compact and easily attached to the pile, thereby resulting in mounting micropiles to the pile for additional support. Use of the micropile connection may decrease the time and expense associated with rectifying refusals.

One embodiment is directed to a micropile connection for supporting a vertical pile. The micropile connection includes a base comprising an upper edge, a lower edge, a left edge, and a right edge. The micropile connection further includes a first micropile sleeve comprising a first inlet, a first outlet, and a first outer surface extending therebetween. At least a portion of the first outer surface is attached to the base such that the first inlet is positioned toward the upper edge and the left edge of the base. The micropile connection further includes a second micropile sleeve comprising a second inlet, a second outlet, and a second outer surface extending therebetween. At least a portion of the second outer surface is attached to the base such that the second inlet is positioned toward the upper edge and the right edge of the base. The first micropile sleeve is configured to direct a first micropile inserted into the first inlet from the left edge across the base toward the right edge. The second micropile sleeve is configured to direct a second micropile inserted into the second inlet from the right edge across the base toward the left edge.

Another embodiment is directed to a beam support system. The beam support system includes a pile extending along a beam axis. The beam support system further includes at least one micropile connection attached to the pile. Each micropile connection includes a base comprising an upper edge, a lower edge, a left edge, and a right edge. Each micropile connection further includes a first micropile sleeve comprising a first inlet, a first outlet, and a first outer surface extending therebetween. At least a portion of the first outer surface is attached to the base such that the first inlet is positioned toward the upper edge and the left edge of the base. Each micropile connection further includes a second micropile sleeve comprising a second inlet, a second outlet, and a second outer surface extending therebetween. At least a portion of the second outer surface is attached to the base such that the second inlet is positioned toward the upper edge and the right edge of the base. The beam support system further includes a first micropile positioned within the first micropile sleeve of each of the at least one micropile connection and extending from the left edge across the base toward the right edge. The beam support system further includes a second micropile positioned within the second micropile sleeve of each of the at least one micropile connection and extending from the right edge across the base toward the left edge.

Another embodiment is directed to a method for forming a beam support system. The method includes positioning a pile vertically to a ground, the pile extending along a beam axis. The method further includes attaching a base of at least one micropile connection to the pile. The method further includes inserting a first micropile at a left edge of the base through a first inlet and a first outlet of a first micropile sleeve of each of the at least one micropile connection. At least a portion of a first outer surface is attached to the base such that the first inlet is positioned toward the upper edge and the left edge of the base. The method further includes inserting a second micropile at a right edge of the base through a second inlet and a second outlet of a second micropile sleeve of each of the at least one micropile connection. At least a portion of a second outer surface is attached to the base such that the second inlet is positioned toward the upper edge and the right edge of the base.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary and are intended to provide an overview or framework for understanding the nature and character of the claims. The accompanying drawings are included to provide a further understanding and are incorporated in and constitute a part of this specification. The drawings illustrate one or more embodiment(s), and together with the description, serve to explain principles and operation of the various embodiments.

DETAILED DESCRIPTION

Figure 1A:
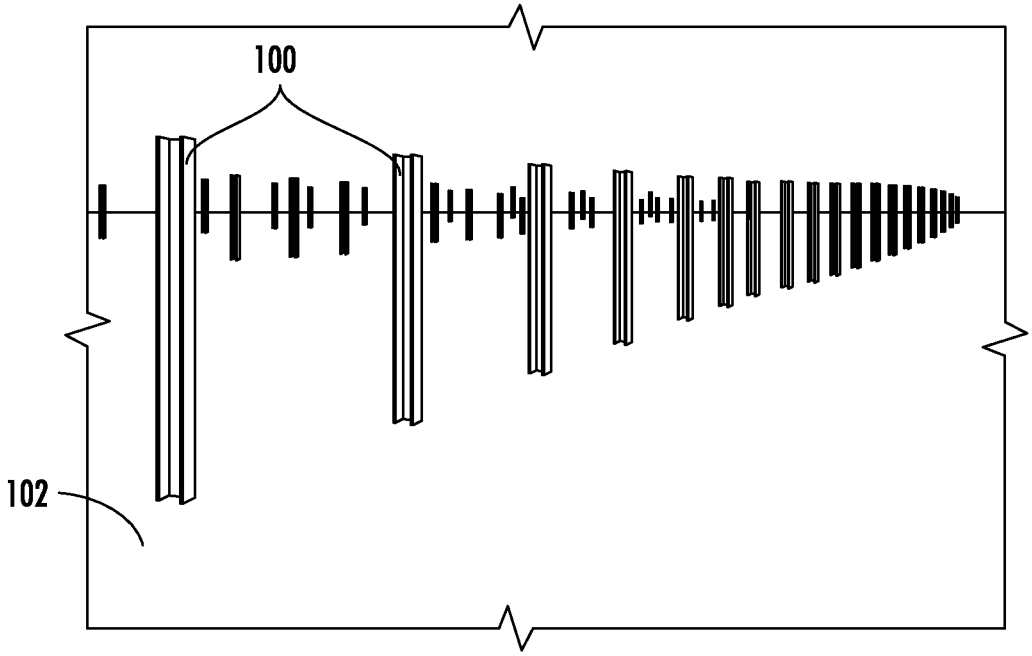
FIG. 1A is a perspective view of a plurality of vertical piles installed for mounting solar panels.
Figure 1B:
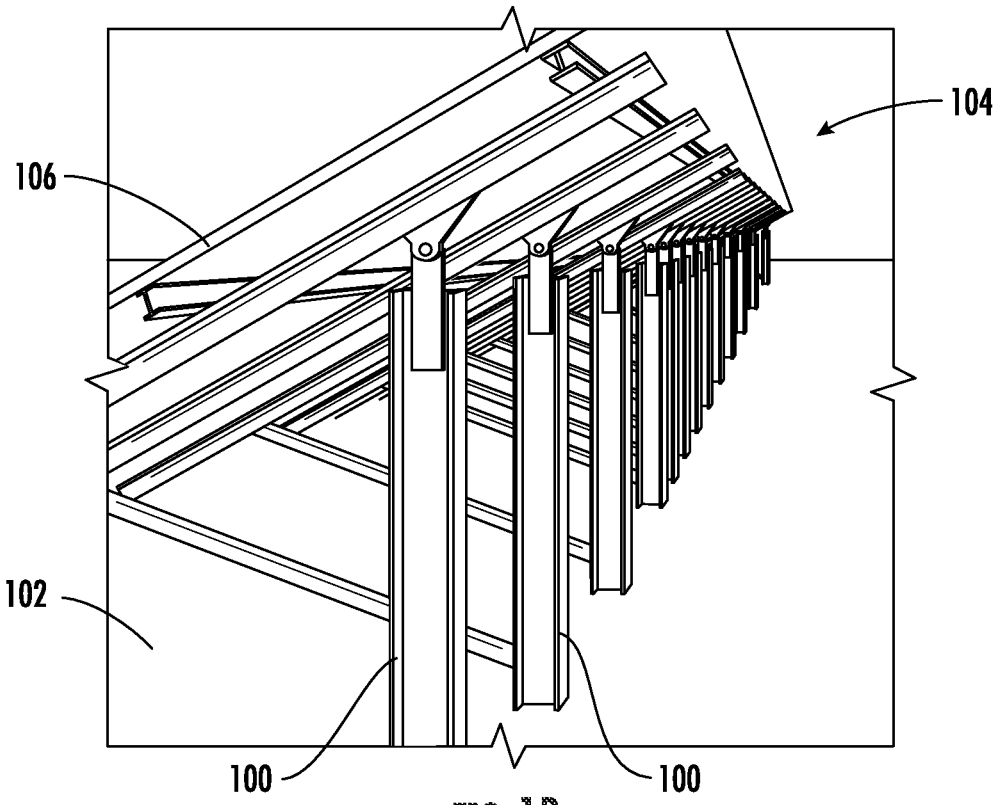
FIG. 1B is a perspective view of a solar panel array including solar panels mounted to the vertical piles.

Reference will now be made in detail to the presently preferred embodiments, examples of which are illustrated in the accompanying drawings. Whenever possible, the same reference numerals will be used throughout the drawings to refer to the same or like parts.

Terms such as "left," "right," "top," "bottom," "front," "back," "horizontal," "parallel," "perpendicular," "vertical," "lateral," "coplanar," and similar terms are used for convenience of describing the attached figures and are not intended to limit this description. For example, terms such as "left side" and "right side" are used with specific reference to the drawings as illustrated, and the embodiments may be in other orientations in use. Further, as used herein, terms such as "horizontal," "parallel," "perpendicular," "vertical," "lateral," etc., include slight variations that may be present in working examples.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present disclosure. As used herein, the term "and/or" includes any and all combinations of one or more of the associated listed items.

It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

As noted above, "refusal" refers to an inability for a pile or beam to reach a desired depth to maintain stability of a structure, such as by an obstruction or impediment (e.g., compacted substrates, rocks, foreign objects, etc.) that impedes driving the pile or beam to the desired depth.

Disclosed is a micropile connection for supporting a vertical pile for a support system (e.g., for refusals). In certain embodiments, the micropile connection and/or support system uses minimal hand-held equipment and/or no excavation or removal of excavated soil. In certain embodiments, the micropile connection and/or support system is adaptable to any terrain and applicable in soils of sand, silt clay, fine gravel, etc. In certain embodiments, the micropile connection and/or support system can reduce design time, construction time, and/or total installation costs.

Figure 2C:
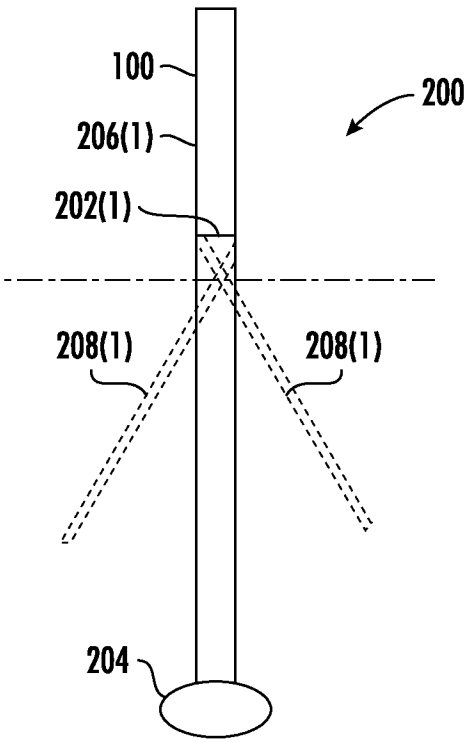
FIG. 2C is a front view of the support system of FIG. 2B.
Figure 2B:
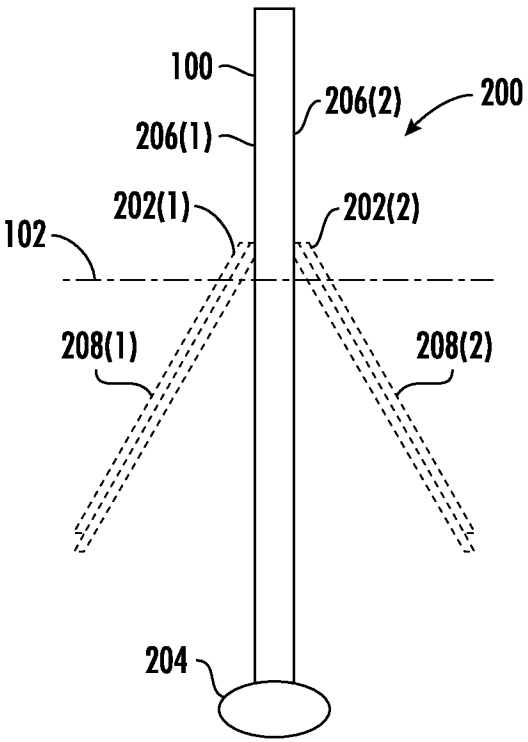
FIG. 2B is a side view of a support system, including two micropile connections attached to a vertical pile to rectify a refusal.
Figure 2A:
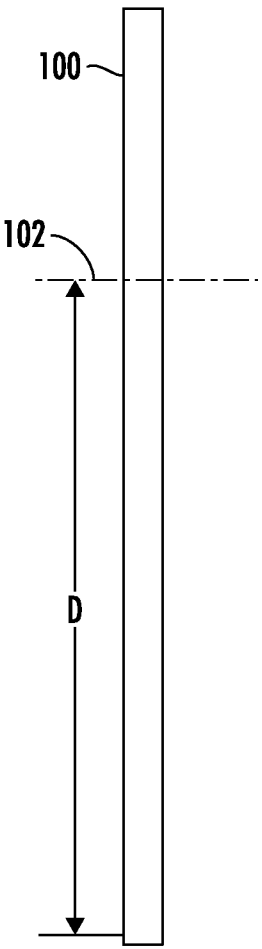
FIG. 2A is a side view of a vertical pile driven into the ground to a required depth.
Figure 3A:
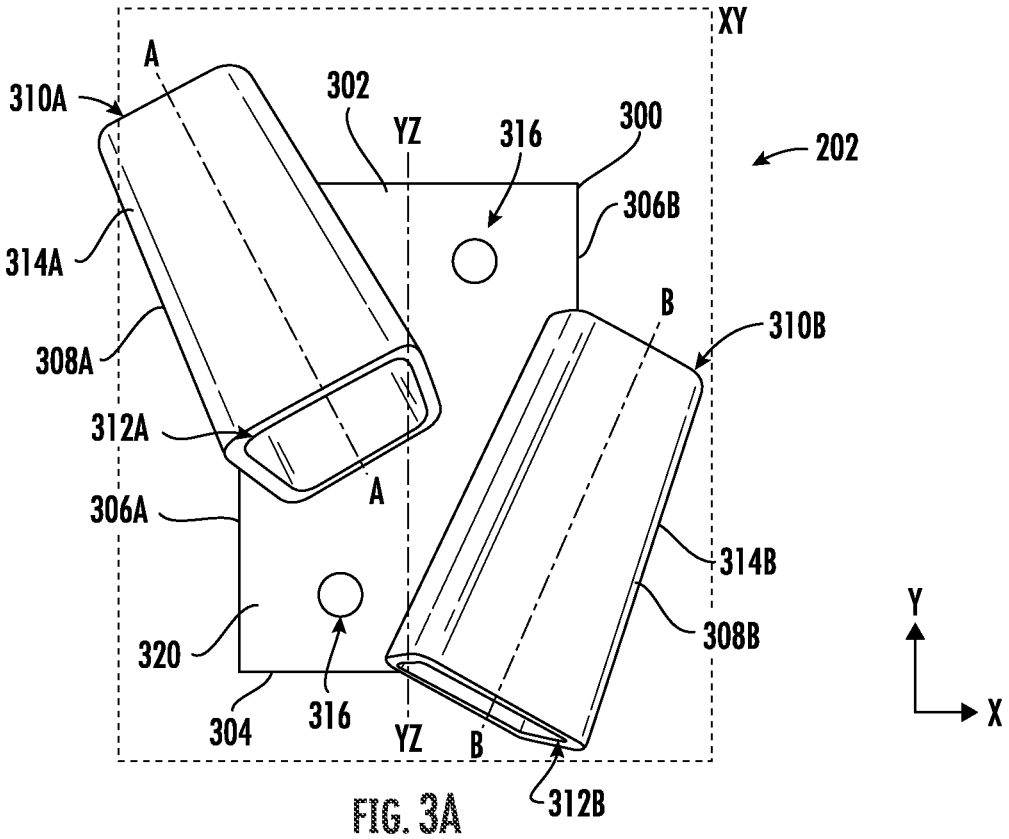
FIG. 3A is a front view of the micropile connection of FIGS. 2B and 2C.
Figure 3B:
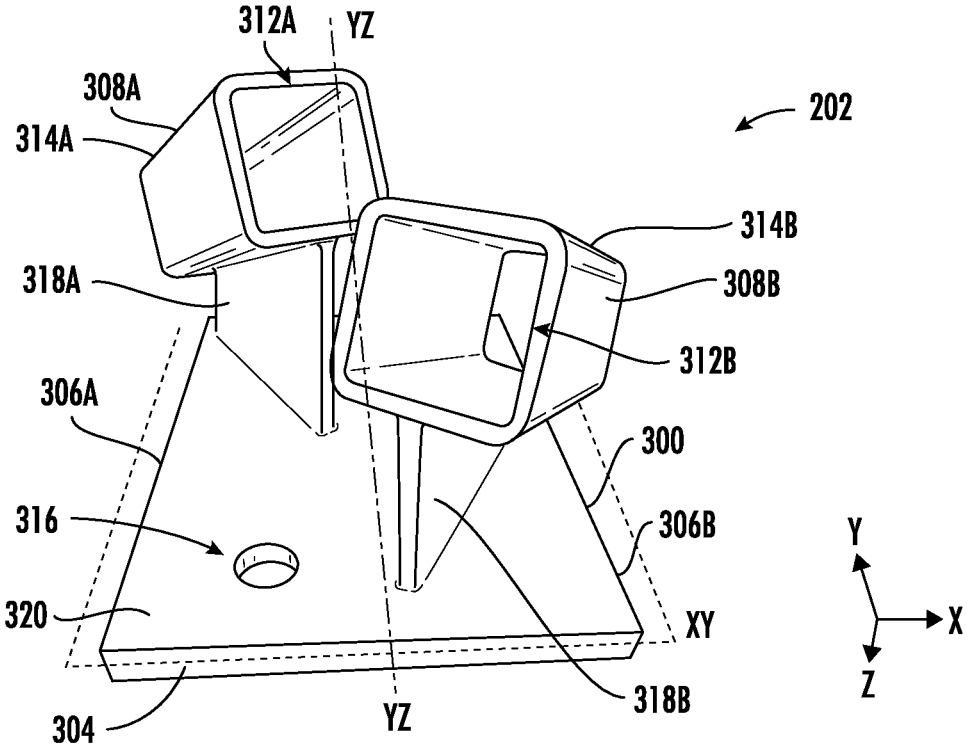
FIG. 3B is a bottom view of the micropile connection of FIG. 3A.
Figure 3C:
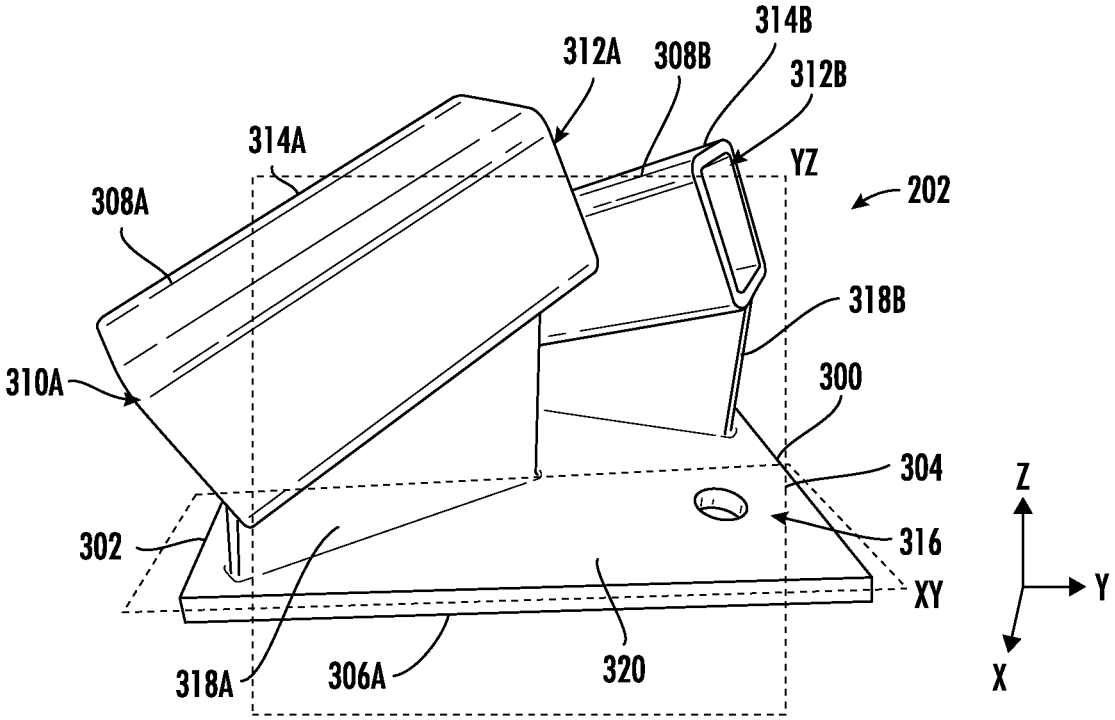
FIG. 3C is a left view of the micropile connection of FIG. 3A.
Figure 3D:
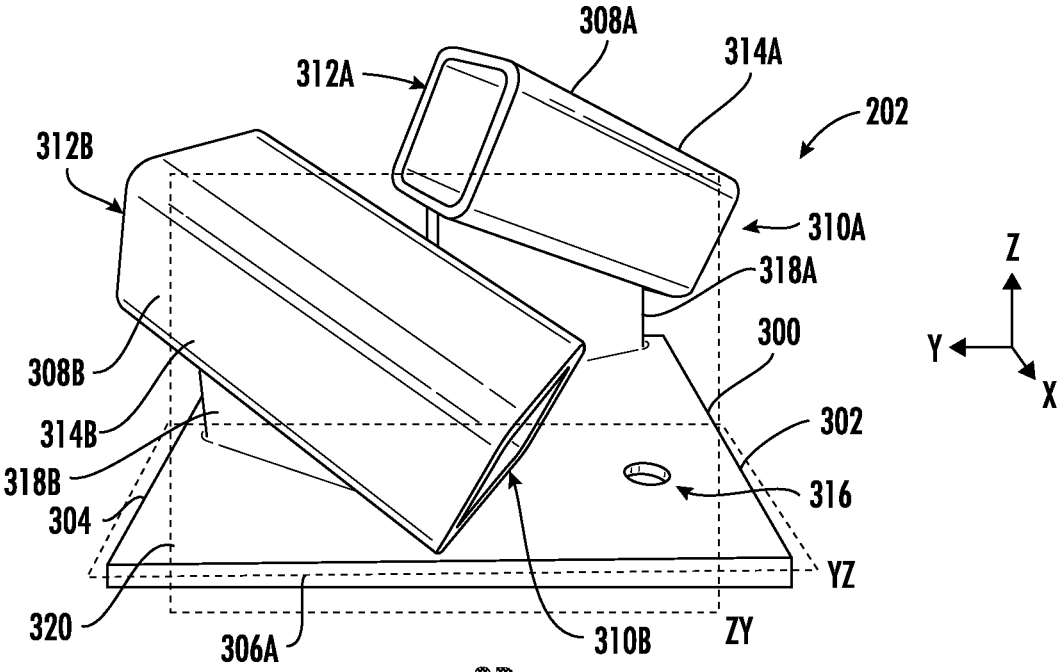
FIG. 3D is a right view of the micropile connection of FIG. 3A.

FIG. 2A is a side view of a vertical pile 100 (may also be referred to as an elongated beam) driven into the ground 102 to a required depth D. In certain embodiments, the pile 100 extends along a beam axis. In certain embodiments, the pile 100 includes structural steel. In certain embodiments, the structural steel includes circular tubing, rectangular tubing, square tubing, I-Beam, W-Beam, or C channel. In certain embodiments, the elongated beam includes timber (e.g., rectangular cross-section, square cross-section, etc.).

FIGS. 2B-2C are views of a support system 200 including two micropile connections 202(1), 202(2) (referred to generally as micropile connections 202) attached to a vertical pile 100 to rectify a refusal. It is noted that "vertical" as used herein, may be generally vertical, such as +/−30 degrees or +/−15 degrees. In particular, the pile 100 is well short of the required depth because the pile 100 has encountered an impediment 204 (e.g., rock). Instead of removing the pile 100 to drill through or remove the impediment 204, the micropile connections 202 are attached to the pile 100. The first micropile connection 202(1) is attached to a first side 206(1) of the pile 100, and the second micropile connection 202(2) is attached to a second side 206(2) of the pile 100. Sets of micropiles 208(1), 208(2) (may be referred to generally as micropiles 208) are then driven through the micropile connections 202 into the ground 102, thereby further supporting the pile 100. Further, the micropiles 208 may be driven away from the impediment 204 and/or to a shallower depth than required for the pile 100.

FIGS. 3A-3D are views of the micropile connection 202 of FIGS. 2B and 2C. The micropile connection 202 includes a base 300, including an upper edge 302, a lower edge 304, a left edge 306A, and a right edge 306B. The micropile connection 202 further includes a first micropile sleeve 308A comprising a first inlet 310A, a first outlet 312A, and a first outer surface 314A extending therebetween. At least a portion of the first outer surface 314A is attached to the base 300 such that the first inlet 310A is positioned toward the upper edge 302 and the left edge 306A of the base 300. A second micropile sleeve 308B includes a second inlet 310B, a second outlet 312B, and a second outer surface 314B extending therebetween. At least a portion of the second outer surface 314B is attached to the base 300 such that the second inlet 310B is positioned toward the upper edge 302 and the right edge 306B of the base 300. It is noted that in certain embodiments, the micropile connection 202 may include additional micropile sleeves 308A, 308B.

The base 300 defines a vertical plane YZ extending between the upper edge 302 and the lower edge 304. The vertical plane YZ is generally located in a center of the base 300 between the left edge 306A and the right edge 306B. Further, the vertical plane YZ is generally perpendicular to the base 300 (e.g., perpendicular to the upper edge 302 and the lower edge 304). The first micropile sleeve 308A is configured to direct a first micropile 208 inserted into the first inlet 310A from the left edge 306A across the base 300 (e.g., through the vertical plane YZ toward the right edge 306B. The second micropile sleeve 308B is configured to direct a second micropile 208 inserted into the second inlet 310B from the right edge 306B across the base 300 (e.g., through the vertical plane YZ) toward the left edge 306A.

The configuration of the first and second micropile sleeves 308A, 308B directs micropiles 208 past each other (e.g., crossing each other in the vertical plane YZ from a front view). This is advantageous as it orients the first and second outlets 312A, 312B at the side edges 306A, 306B of the base 300 to provide sufficient clearance to drive the micropiles 208 through the first and second micropile sleeves 308A, 308B, especially when the micropiles 208 are also directed away from the base 300.

In certain embodiments, the base 300 is a base plate such that the base 300 is planar and rectangular, such as with a width of less than 8 inches and a height of less than 10 inches. In other embodiments, the base 300 has a different shape and/or surface contour (e.g., curvature), such as to mount to a pile 100 with a circular cross-section. In certain embodiments, the base 300 includes at least two apertures 316 (e.g., holes or slots) for mounting the micropile connection 202 to the pile 100. The micropile connection 202 includes a first wedge 318A attaching the first micropile sleeve 308A to the base 300 and a second wedge 318B attaching the second micropile sleeve 308B to the base 300. The micropile sleeves 308A, 308B have a square cross-section, but other cross-sections may be used. For example, in other embodiments, the micropile sleeves 308A, 308B have a rectangular cross-section or a circular cross-section.

In certain embodiments, the first micropile sleeve 308A is a different distance from the upper edge 302 of the base 300 than the second micropile sleeve 308B. In particular, the first inlet 310A of the first micropile sleeve 308A is closer to the upper edge 302 of the base 300 than the second inlet 310B of the second micropile sleeve 308B. In certain embodiments, the second micropile sleeve 308B is a different distance from the lower edge 304 of the base 300 than the first micropile sleeve 308B. In particular, the second outlet 312B of the second micropile sleeve 308B is closer to the lower edge 304 of the base 300 than the first outlet 312A of the first micropile sleeve 308A.

As noted above, the base 300 defines a vertical plane YZ extending between the upper edge 302 and the lower edge 304. The first micropile sleeve 308A defines an axis A extending between the first inlet 310A and the first outlet 312A, and the second micropile sleeve 308B defines an axis B extending between the second inlet 310B and the second outlet 312B. The axis A of the first micropile sleeve 308A is angled relative to the vertical plane YZ to a same degree and in an opposite direction as the axis B of the second micropile sleeve 308B. In certain embodiments, the first micropile sleeve 308A and the second micropile sleeve 308B are angled about 30 degrees relative to the vertical plane V. In such a configuration, the micropiles 208 are then driven into the ground at a 60-degree angle relative to the ground.

Each of the first micropile sleeve 308A and the second micropile sleeve 308B are angled relative to a front surface 320 of the base 300. In particular, the first micropile sleeve 308A and the second micropile sleeve 308B are angled at different angles relative to a front surface 320 of the base 300. The vertical plane YZ is generally perpendicular to the front surface 320 of the base 300. In certain embodiments, the first micropile sleeve 308A is angled between 25 and 28 degrees relative to the front surface 320 of the base 300, and/or the second micropile sleeve 308B is angled between 22 and 25 degrees relative to the front surface 320 of the base 300. The first micropile sleeve 308A is configured to direct the first micropile 100 over the second micropile sleeve 308B.

The first micropile sleeve 308A and the second micropile sleeve 308B are angled by the first wedge 318A and the second wedge 318B. In certain embodiments, the first wedge 318A is welded to the first micropile sleeve 308A and the base 300, and the second wedge 318B is welded to the second micropile sleeve 308B and the base 300.

The first wedge 318A is configured to offset the first inlet 310A of the first micropile sleeve 308A from the front surface 320 of the base 300 to provide clearance for driving a first micropile 100 through the first micropile sleeve 308A. The second wedge 318B is configured to offset the second inlet 310B of the second micropile sleeve 308B from the front surface 320 of the base 300 to provide clearance for driving the second micropile 100 through the second micropile sleeve 308B. In certain embodiments, an offset of the first inlet 310A from the front surface 320 is different from an offset of the second inlet 310B from the front surface 320. In such a configuration the micropile sleeves 308A, 308B are configured such that the second micropile 100 is positioned between the base 300 and the first micropile 100.

Relative to the base 300, the first and second micropile sleeves 308A, 308B are rotated in two dimensions. In particular, the first and second micropile sleeves are rotated within an XY plane defined by the base 300 (i.e., around a z-axis through a thickness of the base 300) and rotated within a YZ plane (i.e., around an x-axis extending through the left edge 306A and right edge 306B of the base 300). This directs the micropiles 208 outward from the pile 100.

The offset positioning of the first and second micropile sleeves 308A, 308B relative to the base 300, the orientation of the first and second micropile sleeves 308A, 308B relative to the upper edge 302 and the left and right edges 306A, 306B, and/or the rotation of the first and second micropile sleeves 308A, 308B relative to the base 300 result in a compact and effective design for securing micropiles 208 to a pile 100.

Figure 4A:
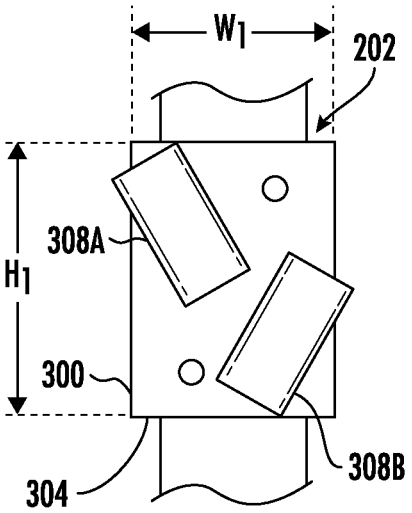
FIG. 4A is a schematic drawing of a front view of one embodiment of the micropile connection of FIGS. 3A-3D.

FIGS. 4A-4D are schematic drawings of one embodiment of the micropile connection 202 of FIGS. 3A-3D. It is noted that the dimensions discussed below are exemplary and that other dimensions may be used. Referring to FIG. 4A, the base 300 is rectangular with a width W1 of 3-8 inches (e.g., 5.5 inches) and a height H1 of 5-10 inches (e.g., 7.5 inches). The first micropile sleeve 308A and the second micropile sleeve 308B are angled at 40-80 degrees (e.g., 60 degrees) relative to the bottom edge 304. In certain embodiments, at least a portion of the first micropile sleeve 308A and/or the second micropile sleeve 308B extend outside of a footprint of the base 300. In certain embodiments, at least a portion of the first micropile sleeve 308A and/or the second micropile sleeve 308B extend past a width of the base 300 and/or do not extend past a height of the base 300.

Figure 4B:
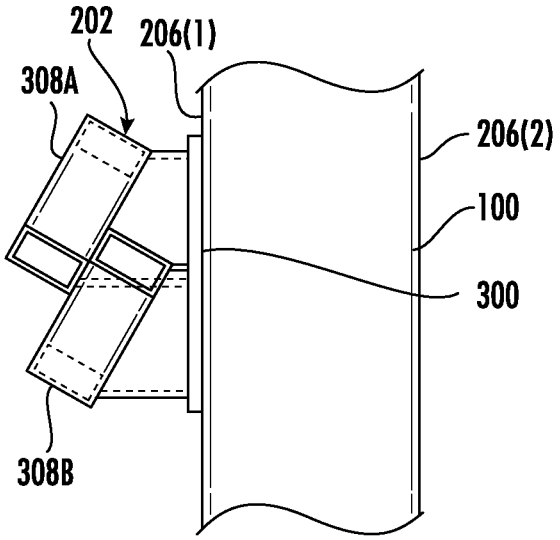
FIG. 4B is a schematic drawing of a side view of the embodiment of the micropile connection of FIG. 4A.

Referring to FIG. 4B, the base 300 sits against the first side 206(1) of the pile 100. Although not illustrated, it is noted that as described above, a second micropile connection 202 could be attached to the second side 206(2) of the pile 100. In some embodiments, additional micropile connections 202 could be applied to additional sides of the pile 100.

Figure 4C:
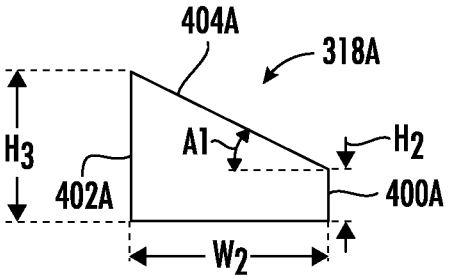
FIG. 4C is a schematic drawing of a side view of a first wedge of the micropile connection of FIG. 4A.

Referring to FIG. 4C, the first wedge 318A has a width W2 of 2-6 inches (e.g., 4 inches), a height H2 of an inlet edge 400A is 0.5-2 inches (e.g., 1 inch), a height H3 of an outlet edge 402A is 1-5 inches (e.g., 3 inches), and a top tapered surface 404A is angled A1 at 20-40 degrees (e.g., 26.6 degrees). Thus, the corresponding angle of the first micropile sleeve 308A is also 20-40 degrees (e.g., 26.6 degrees). Of course, other angles could be used. For example, the top tapered surface 404A could be within 20-30 degrees.

Figure 4D:
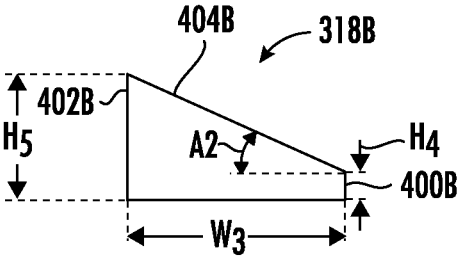
FIG. 4D is a schematic drawing of a side view of a second wedge of the micropile connection of FIG. 4A.

Referring to FIG. 4D, the second wedge 318B has a width W3 of 2-6 inches (e.g., 4 inches), a height H4 of an inlet edge 400B is 0.1-1.5 inches (e.g., 0.5 inches), a height H5 of an outlet edge 402B is 1-4 inches (e.g., 2.25 inches), and a top tapered surface 404B is angled A2 at 15-35 degrees (e.g., 23.6 degrees). Thus, the corresponding angle of the second micropile sleeve 308B is also 15-35 degrees (e.g., 23.6 degrees). Of course, other angles could be used. For example, the top tapered surface 404B could be within 20-30 degrees.

As noted above, the inlet offset of the inlet edges 400A, 400B provide sufficient clearance for driving the micropiles 208 into the first and second micropile sleeves 308A, 308B.

Figure 5B:
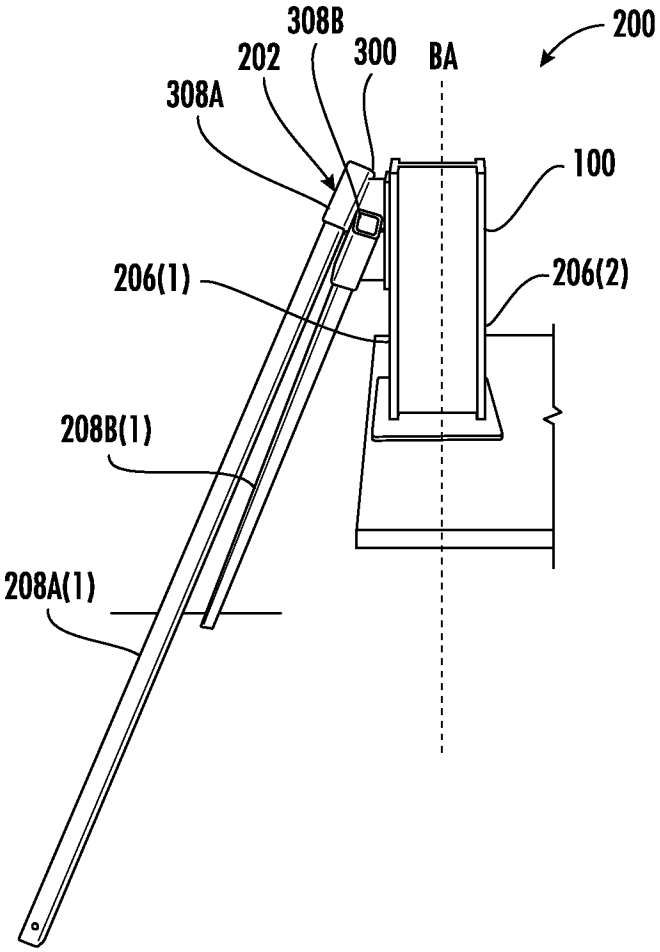
FIG. 5B is a side view of the support system of FIG. 5A.
Figure 5A:
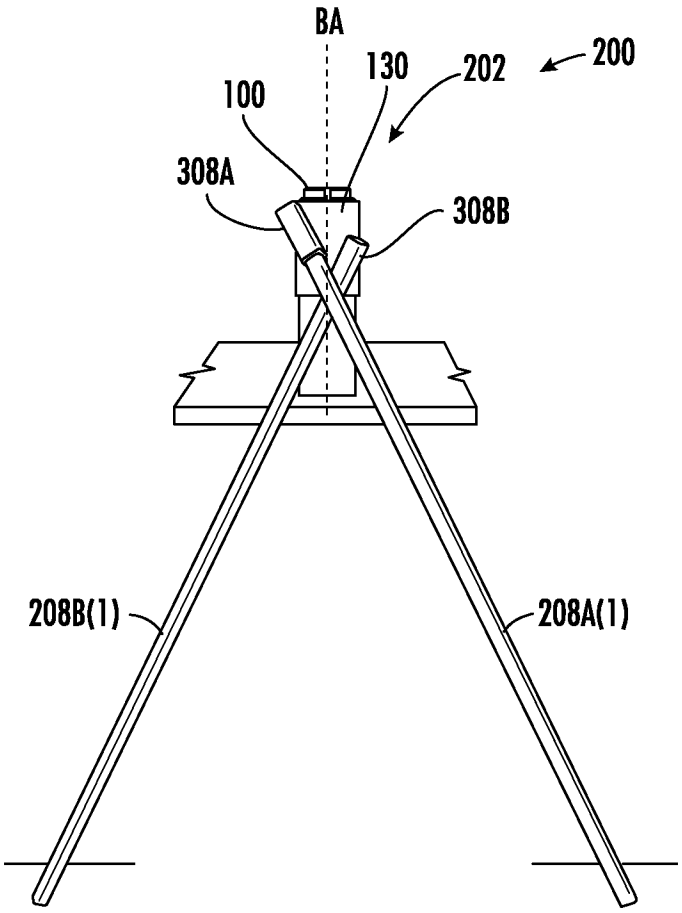
FIG. 5A is a front view of an illustrative support system, including the micropile connection of FIGS. 3A-3D.

FIGS. 5A and 5B are views of an illustrative support system 200, including the micropile connection 202 of FIGS. 3A-3D. The beam support system 200 includes a pile 100 extending along a beam axis BA. At least one micropile connection 202 is attached to the pile 100. Each micropile connection 202 includes a base 300, including an upper edge 302, a lower edge 304, a left edge 306A, and a right edge 306B (see FIGS. 3A-3D).

Each micropile connection 202 also includes a first micropile sleeve 308A comprising a first inlet 310A, a first outlet 312A, and a first outer surface 314A extending therebetween (see FIGS. 3A-3D). At least a portion of the first outer surface 314A is attached to the base 300 such that the first inlet 310A is positioned toward the upper edge 302 and the left edge 306A of the base 300. Each micropile connection 202 also includes a second micropile sleeve 308B, including a second inlet 310B, a second outlet 312B, and a second outer surface 314B extending therebetween (see FIGS. 3A-3D). At least a portion of the second outer surface 314B is attached to the base 300 such that the second inlet 310B is positioned toward the upper edge 302 and the right edge 306B of the base 300. A first micropile 208A(1) is positioned within the first micropile sleeve 308A of the at least one micropile connection 202 and extending from the left edge 306A across the base 300 toward the right edge 306B. A second micropile 208B(1) is positioned within the second micropile sleeve 308B of the at least one micropile connection 202 and extending from the right edge 306B across the base toward the left edge 306A.

Although one set of micropiles 208A(1), 208B(1) is illustrated, it is noted that a second micropile connection 202 with a second set of micropiles 208 could also be used. In particular, in certain embodiments, at least one micropile connection 202 includes a first micropile connection 202 attached to a first side 206(1) of a pile 100 and a second micropile connection 202 attached to a second side 206(2) of the pile 100.

As noted above, in certain embodiments, the pile 100 includes structural steel (e.g., circular tubing, rectangular tubing, square tubing, I-Beam, W-Beam, or C channel).

Figure 6:
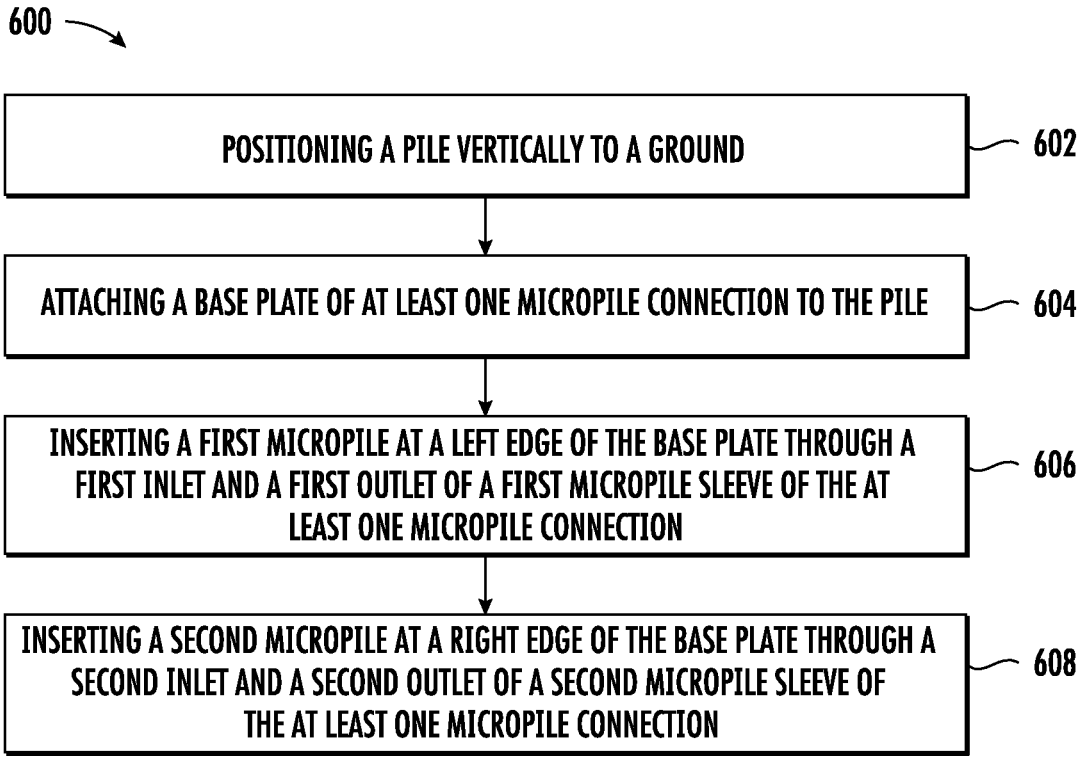
FIG. 6 is a flowchart illustrating a method for forming a support system.

FIG. 6 is a flowchart 600 illustrating a method for forming a support system 200. Step 602 includes positioning a pile 100 vertically to a ground, the pile 100 extending along a beam axis. Step 604 includes attaching a base 300 of at least one micropile connection 202 to the pile 100. In certain embodiments, attaching a base 300 of at least one micropile connection 202 includes attaching a first micropile connection 202A to a first side 206(1) of the pile 100 and a second micropile connection 202B to a second side 206(2) of the pile 100.

Step 606 includes inserting a first micropile 208A at a left edge 306A of the base 300 through a first inlet 310A and a first outlet 312A of a first micropile sleeve 308A of the at least one micropile connection 202. At least a portion of a first outer surface 314A is attached to the base 300 such that the first inlet 310A is positioned toward the upper edge 302 and the left edge 306A of the base 300.

Step 608 includes inserting a second micropile 208B at a right edge 306B of the base 300 through a second inlet 310B and a second outlet 312B of a second micropile sleeve 308B of the at least one micropile connection 202. At least a portion of a second outer surface 314B is attached to the base 300 such that the second inlet 310B is positioned toward the upper edge 302 and the right edge 306B of the base 300.

It will be apparent to those skilled in the art that various modifications and variations can be made without departing from the spirit or scope of the invention.

Many modifications and other embodiments of the embodiments set forth herein will come to mind to one skilled in the art to which the embodiments pertain having the benefit of the teachings presented in the foregoing descriptions and the associated drawings. Therefore, it is to be understood that the description and claims are not to be limited to the specific embodiments disclosed and that modifications and other embodiments are intended to be included within the scope of the appended claims. It is intended that the embodiments cover the modifications and variations of the embodiments provided they come within the scope of the appended claims and their equivalents. Although specific terms are employed herein, they are used in a generic and descriptive sense only and not for purposes of limitation.

What is claimed is:

1. A micropile connection for supporting a vertical pile, comprising:

a base comprising an upper edge, a lower edge, a left edge, and a right edge;

a first micropile sleeve comprising a first inlet, a first outlet, and a first outer surface extending therebetween, at least a portion of the first outer surface attached to the base and extending outside of a footprint of the base such that the first inlet is positioned toward the upper edge and the left edge of the base; and a second micropile sleeve comprising a second inlet, a second outlet, and a second outer surface extending therebetween, at least a portion of the second outer surface attached to the base and extending outside of a footprint of the base such that the second inlet is positioned toward the upper edge and the right edge of the base;

wherein the first micropile sleeve is configured to direct a first micropile inserted into the first inlet from the left edge across the base toward the right edge;

wherein the second micropile sleeve is configured to direct a second micropile inserted into the second inlet from the right edge across the base toward the left edge;

wherein the first micropile sleeve is a different distance from the upper edge than the second micropile sleeve; and wherein the micropile connection comprises at least one of the following features (i) and (ii):

(i) the first inlet of the first micropile sleeve is offset a first distance from the base, and the second micropile sleeve is offset a second distance from the base greater than the first distance; and (ii) the first micropile sleeve and the second micropile sleeve are angled at different angles relative to a front surface of the base.

2. The micropile connection of claim 1, wherein the base is rectangular with a width less than 8 inches and a height less than 10 inches.

3. The micropile connection of claim 1, wherein the base comprises at least two apertures for mounting the micropile connection to the vertical pile.

4. The micropile connection of claim 1, wherein the base defines a vertical axis extending between the upper edge and the lower edge, the first micropile sleeve angled relative to the vertical axis to a same degree and in an opposite direction as the second micropile sleeve.

5. The micropile connection of claim 4, wherein the first micropile sleeve and the second micropile sleeve are angled about 30 degrees relative to the vertical axis.

6. The micropile connection of claim 1, wherein the first inlet of the first micropile sleeve is offset a first distance from the base and the second micropile sleeve is offset a second distance from the base greater than the first distance.

7. The micropile connection of claim 6, wherein the first micropile sleeve and the second micropile sleeve are angled at different angles relative to the front surface of the base.

8. The micropile connection of claim 7, wherein the base defines a vertical axis extending between the upper edge and the lower edge, the first micropile sleeve angled relative to the vertical axis to a same degree and in an opposite direction as the second micropile sleeve.

9. The micropile connection of claim 1, wherein the first micropile sleeve and the second micropile sleeve are angled at different angles relative to the front surface of the base.

10. The micropile connection of claim 1, further comprising a first wedge attaching the first micropile sleeve to the base and a second wedge attaching the second micropile sleeve to the base.

11. A micropile connection for supporting a vertical pile, comprising:

a base comprising an upper edge, a lower edge, a left edge, and a right edge;

a first micropile sleeve comprising a first inlet, a first outlet, and a first outer surface extending therebetween, at least a portion of the first outer surface attached to the base such that the first inlet is positioned toward the upper edge and the left edge of the base; and a second micropile sleeve comprising a second inlet, a second outlet, and a second outer surface extending therebetween, at least a portion of the second outer surface attached to the base such that the second inlet is positioned toward the upper edge and the right edge of the base;

wherein the first micropile sleeve is configured to direct a first micropile inserted into the first inlet from the left edge across the base toward the right edge;

wherein the second micropile sleeve is configured to direct a second micropile inserted into the second inlet from the right edge across the base toward the left edge; and wherein the first micropile sleeve and the second micropile sleeve are angled at different angles relative to a front surface of the base.

12. The micropile connection of claim 11, wherein the first micropile sleeve is angled between 25 and 28 degrees relative to the front surface of the base, and the second micropile sleeve is angled between 22 and 25 degrees relative to the front surface of the base.

13. The micropile connection of claim 11, wherein the base comprises at least two apertures for mounting the micropile connection to the vertical pile.

14. The micropile connection of claim 11, wherein the base defines a vertical axis extending between the upper edge and the lower edge, the first micropile sleeve angled relative to the vertical axis to a same degree and in an opposite direction as the second micropile sleeve.

15. The micropile connection of claim 11, further comprising a first wedge attaching the first micropile sleeve to the base and a second wedge attaching the second micropile sleeve to the base.

16. The micropile connection of claim 11, wherein the first micropile sleeve is a different distance from the upper edge than the second micropile sleeve;

wherein the base defines a vertical axis extending between the upper edge and the lower edge, the first micropile sleeve angled relative to the vertical axis to a same degree and in an opposite direction as the second micropile sleeve;

wherein the first micropile sleeve and the second micropile sleeve are angled at different angles relative to a front surface of the base; and wherein the first inlet of the first micropile sleeve is offset a first distance from the base and the second micropile sleeve is offset a second distance from the base greater than the first distance.

17. A micropile connection for supporting a vertical pile, comprising:

a base comprising an upper edge, a lower edge, a left edge, and a right edge;

a first micropile sleeve comprising a first inlet, a first outlet, and a first outer surface extending therebetween, at least a portion of the first outer surface attached to the base such that the first inlet is positioned toward the upper edge and the left edge of the base; and a second micropile sleeve comprising a second inlet, a second outlet, and a second outer surface extending therebetween, at least a portion of the second outer surface attached to the base such that the second inlet is positioned toward the upper edge and the right edge of the base;

wherein the first micropile sleeve is configured to direct a first micropile inserted into the first inlet from the left edge across the base toward the right edge;

wherein the second micropile sleeve is configured to direct a second micropile inserted into the second inlet from the right edge across the base toward the left edge; and further comprising a first wedge attaching the first micropile sleeve to the base and a second wedge attaching the second micropile sleeve to the base;

wherein:

the first wedge is configured to offset the first inlet from a front surface of the base by a first offset distance to provide clearance for driving the first micropile through the first micropile sleeve;

the second wedge is configured to offset the second inlet from the front surface of the base by a second offset distance to provide clearance for driving the second micropile through the second micropile sleeve; and the first offset distance of the first inlet from the front surface is different from the second offset distance of the second inlet from the front surface.

18. The micropile connection of claim 17, wherein the base comprises at least two apertures for mounting the micropile connection to the vertical pile.

19. The micropile connection of claim 17, wherein the base defines a vertical axis extending between the upper edge and the lower edge, the first micropile sleeve angled relative to the vertical axis to a same degree and in an opposite direction as the second micropile sleeve.

20. The micropile connection of claim 17, wherein the first micropile sleeve and the second micropile sleeve are angled at different angles relative to a front surface of the base.

* * * * *